United States Patent [19]

Burdette

[11] 4,410,749

[45] Oct. 18, 1983

[54] LIQUID HYDROCARBON AIR BREATHER FUEL

[75] Inventor: George W. Burdette, Ridgecrest, Calif.

[73] Assignee: The United States of America as represented by the Secretary of the Navy, Washington, D.C.

[21] Appl. No.: 310,553

[22] Filed: Oct. 13, 1981

[51] Int. Cl.[3] ..... C10C 1/16

[52] U.S. Cl. ..... 585/14; 585/21; 585/22; 585/23; 208/15

[58] Field of Search ..... 585/14, 21, 22, 23; 208/15

[56] References Cited

U.S. PATENT DOCUMENTS

| | | | |
|---|---|---|---|
| 4,087,257 | 5/1978 | Burdette | 585/14 |
| 4,207,080 | 6/1980 | Suld et al. | 585/22 |
| 4,222,800 | 9/1980 | Myers, Jr. et al. | 149/109.600 |
| 4,270,014 | 5/1981 | Norton et al. | 585/14 |
| 4,286,109 | 8/1981 | Norton et al. | 585/14 |
| 4,320,238 | 3/1982 | Norton et al. | 585/14 |

*Primary Examiner*—Charles F. Warren
*Assistant Examiner*—Harris-Smith Y.
*Attorney, Agent or Firm*—R. F. Beers; W. Thom Skeer

[57] ABSTRACT

A high energy, high density synthetic liquid hydrocarbon fuel, RJ-6, is prepared by blending 60 weight percent perhydrodinorbornadiene, a synthetic fuel known as RJ-5, and 40 weight percent exo-tetrahydrocyclopentadiene, a synthetic fuel known as JP-10. This fuel is particularly suitable for use in air launched ramjet engine applications such as aircraft missile systems. This new fuel substantially meets the desirable viscosity, energy content, and flash point of the previously employed synthetic fuel blend while exhibiting superior storage characteristics in elastomeric fuel systems used in missile applications.

1 Claim, No Drawings

LIQUID HYDROCARBON AIR BREATHER FUEL

BACKGROUND OF THE INVENTION

This invention relates to the field of fuels, particularly liquid hydrocarbon fuel, and more particularly, high energy fuel for use in either jet or rocket propulsion. The invention more particularly pertains to high energy, high density synthetic fuels for use in missile and aircraft applications and is useful in ramjet, turbojet, and pulse jet engines. The invention is also applicable to rocket propulsion systems, i.e., those containing their own oxygen or oxidizing agent. This invention more particularly relates to an improved fuel for air launched ramjets having significantly lower viscosity, but substantially equivalent heating value than the presently used fuel known as RJ-5.

Fuels for military use and specifically United States Navy air launched ramjets must meet the requirements of high volumetric heating value, low viscosity, five year storage capability, excellent combustion characteristics, low toxicity, low cost, low freezing point, flash point no lower than 60° C., compatibility with common materials, and absence of ionizable compounds. Heating value, viscosity, and cost are primary factors in choosing a fuel for ramjet application. A fuel having high viscosity is detrimental to the design and operation of air launched missiles since the missiles tend to become cold-soaked when during a mission they are carried at altitude prior to launch by an aircraft.

Present missile designs rely on a collapsible fuel cell whereby fuel pumping for delivery to the engine is accomplished through bleeding of high pressure engine exhaust gases to the annular space between the missile wall and the fuel cell. Unduly high fuel viscosity leads to inefficient operation of the fuel delivery system. Also, high viscosity fuel may fail to ignite in the ramjet engine leading to operational failure of the missile. Viscosity problems are further experienced when missiles are operated in cold climates where fuel viscosity accordingly increases.

Collapsible fuel cells are generally constructed of elastomeric materials. Fuels having components which tend to soften or otherwise attack the elastomeric fuel cells as well as seals, gaskets, or other fuel system components cannot be tolerated in air launched missile applications. This is particularly true since it is an established operational requirement that such missiles be capable of hermetic sealing and five year storage while in a fueled state, i.e., ready for launch. Failure of elastomeric cells could result in missile failure or explosion.

A prior art fuel, designated for military applications as RJ-5, and known as Shelldyne H, is more specifically described as a high density hydrocarbon fuel composed of perhydrodinorbornadiene, a hydrogenated dimerized norbonadiene prepared as described in U.S. Pat. No. 4,222,800 to Myers, Jr. et al. and references cited therein. RJ-5 is useful for ramjet air launch missile systems, but exhibits a viscosity high enough to limit the system's effectiveness in which it is employed. A fuel meeting other requirements, but exhibiting a lower viscosity under similar operational conditions would be highly desirable for the reasons outlined above.

The presently employed fuel for air launched ramjet application, designated as SI-80 which is formulated of 80 weight percent RJ-5 and 20 weight percent iso-butylbenzene, was developed to meet ramjet engine requirements while exhibiting a lower viscosity. SI-80 has a viscosity of 162 cps. at −40° C., a flash point of 69° C. and a heating value of 154,000 Btu/gal. The SI-80 formulation was chosen as the best available when considering its desirable viscosity, flash point, and energy content while meeting other requirements. A major disadvantage of SI-80 fuel is its tendency to attack elastomeric materials such as fuel cells and fuel system seals, etc., thus limiting its storability in a missile fuel system. Also, the toxicity of SI-80 to handling personnel, although found acceptable by the Navy, is of such a level as to bear improvement. This is thought to be attributable to the aromatic character of the isobutylbenzene component.

It has been suggested in the Myers, Jr. et al. patent that specific isomers or mixtures of specific isomers of hydrogenated norbornadiene dimers be blended with exo-tetrahydrodicyclopentadiene (exo-THDCP) designated JP-10, a known hydrocarbon fuel having unacceptable viscosities for the missile applications envisioned herein, for use as a fuel. These specific isomers, due to their high cost, are impractical as fuel components.

SUMMARY OF THE INVENTION

A new high density liquid hydrocarbon fuel designated RJ-6 (SE-60) was formulated with a preferred composition of 60 weight percent RJ-5, perhydrodinorbornadiene, and 40 weight percent of JP-10, exo-tetrahydrodicyclopentadiene. The new fuel unexpectedly meets the advantageous properties of the previously proposed SI-80, a synthetic hydrocarbon blend, exhibits reduced degradation of elastomeric elements in missile fuel systems, and is non-aromatic in character leading to lower toxicity to personnel.

OBJECTS OF THE INVENTION

An object of this invention is to provide a high energy, high density, low viscosity liquid hydrocarbon fuel meeting all U.S. Navy specifications for use in air launched ramjet propulsion systems.

Another object is to provide a fuel for air launched ramjet applications which will not substantially degrade elastomeric propulsion system components.

Still another object is to provide a fuel for air launched ramjet missiles which will not seriously degrade elastomeric propulsion system components under conditions where the missiles are hermetically sealed and stored for up to five years before use.

DESCRIPTION OF THE PREFERRED EMBODIMENT

A high energy, high density liquid hydrocarbon synthetic fuel for air launched ramjets was prepared through the specific blending of two stocks, RJ-5 and JP-10. RJ-5, a military designation, is commercially available as Shelldyne H and is composed of a production run mixture of various isomers of perhydrodinorbornadiene. JP-10 is the military designation for exo-tetrahydrodicyclopentadiene.

Physical properties of pure RJ-5, exo-THDC and JP-5 are shown below in Table 1. JP-5 is the standard jet propulsion fuel used by the U.S. Navy.

TABLE 1

HEAT FUELS

| Fuel | Formula | Density (20°) | Flash Pt. (°C.) | Viscosity (cp.) | Freezing Pt. (°C.) | Cost/Lb ($) | Δ Hc (net) Btu/gal | Δ Hc (net) Btu/lb | % Δ Hc (Btu/gal) Above JP-5 |
|---|---|---|---|---|---|---|---|---|---|
| Exo-Tetrahydrodicyclopentadiene (exo-THDC) | $C_{10}H_{16}$ | 0.9360 @ 16 | 56 | 4 @ 20<br>8.5 @ −18<br>17 @ −40 | Below −40 | 1.00 | 141,700 | 18,140 | 12 |
| RJ-5 | $C_{14}H_{18.4}$ | 1.08 @ 16 | 116 | 28 @ 20<br>235 @ −18<br>1876 @ −40 | Below −40 | 10.00 | 161,000 | 17,870 | 23 |
| JP-5 | | 0.788–0.845 | 60° min. | 2.5 @ 20<br>5 @ −18<br>14 @ −40 | −46° max. | .06 | 125,000 | 18,300 min. | 0 |

Various blends of RJ-5 and JP-10 were prepared including the RJ-6 blend and their resulting properties determined. This data is presented below in Table 2 along with comparative data of SI-80.

TABLE 2

FUEL BLENDS

| Fuels | Density (20°) | Flash Pt. (°C.) | Viscosity (cp.) | Freezing Pt. (°C.) | Cost/Lb ($) | Δ Hc(Net) Btu/Gal | Δ Hc(Net) Btu/lb | % Δ Hc(Btu/Gal) Above JP-5 |
|---|---|---|---|---|---|---|---|---|
| RJ-5/10 wt % exo-THDC | 1.060 | ≧60 | 20 @ 20<br>135 @ −18<br>970 @ −40 | Below −40 | 9.25 | 158,470 | 17,900 | 21 |
| RJ-5/20 wt % exo-THDC | 1.050 | ≧60 | 15 @ 20<br>110 @ −18<br>575 @ −40 | Below −40 | 8.50 | 156,550 | 17,870 | 20 |
| RJ-5/30 wt % exo-THDC | 1.030 | ≧60 | 10 @ 20<br>60 @ −18<br>260 @ −40 | Below −40 | 7.75 | 154,600 | 17,970 | 19 |
| RJ-5/40 wt % exo-THDC (RJ-6) | 1.020 | 66 | 8 @ 20<br>40 @ −18<br>154 @ −40 | Below −40 | 7.00 | 152,950 | 17,970 | 18 |
| RJ-5/20 wt % i-butylbenzene (SI-60) | 1.020 | 69 | 8 @ 20<br>40 @ −18<br>162 @ −40 | Below −40 | 8.50 | 154,000 | 18,100 | 19 |

As may be seen from Table 1 pure exo-THDC exhibits desirable viscosity but has an unacceptable flash point, i.e., below 60° C. Pure RJ-5 has a viscosity unacceptably high when compared to SI-80. The RJ-5/40 weight percent exo-THDC (RJ-6), however, exhibits a viscosity and combustion heating value comparable to that of SI-80 while maintaining an acceptable flash point. Also note the significantly lower cost of RJ-6.

The candidate RJ-6 was then compared to SI-80 in tests to determine storability in elastomeric fuel bladders. Fuel bladders of butadiene-acrylonitrile rubber with 13 weight percent triglycol ester as plasticizer were filled to 90% volume and purged with argon and sealed for 35 months at room temperature. It was found that although both fuels exhibited substantial plasticizer leaching during the 35 month storage test, the bladders containing fuel with the constituent i-butylbenzene (SI-80) permeated the walls, wetting the bladder exterior while the RJ-6 did not exhibit any leakage.

The underlying reason for the above mentioned phenomena has not been definitely established. Such evidence as is available, however, indicates that a fuel stored in the bladder tends to effectively become the plasticizer after the original plasticizer is totally leached out or comes to equilibrium with the stored fuel. Since the fuels are usually more volatile than the original plasticizer, it is important that they remain in the bladder at all times until the time of end use. Otherwise evaporation of the fuel from the bladder would result in hardening and cracking. Therefore, it is unlikely that fuels that do not in part permeate to and wet the outside bladder surface will cause missile failure even though those fuels may exhibit significant plasticizer leaching. It may be concluded, then, that the RJ-6 substantially meets the advantageous properties of SI-80 while surprisingly exhibiting superior compatibility with elastomeric bladder fuel systems during long-term storage resulting in greater safety and reliability in air launched ramjet missile applications.

In summary, a high energy, hydrocarbon fuel suitable for air launched ramjet applications and, particularly, missiles has been formulated which has substantially the desirable viscosity, energy, and flash point properties of SI-80 fuel while exhibiting unexpectedly improved storability in elastomeric fuel systems. This new fuel, formulated as a 60/40 weight percent mixture of RJ-5 and JP-10 also exhibits lower cost than SI-80 and avoids the use of aromatic components such as i-butylbenzene, which tends to be more toxic than aliphatic compounds.

Obviously many modifications and variations of the present invention are possible in light of the above teachings. It is therefore to be understood that within the scope of the appended claims the invention may be practiced otherwise than as specifically described.

What is claimed is:

1. A composition of matter having a density of about 1.020 gram/per cubic centimeter and a viscosity of about 8 centipoises at 20° C., a viscosity of about 154 centipoises at −40° C. and a flash point of about 66° C., useful as a fuel, consisting essentially of about 60 weight percent RJ-5, a production run fuel having as components at least two different isomers of perhydrodinorbornadiene, and about 40 weight percent JP-10, exo-tetrahydrodicyclopentadiene.

* * * * *